United States Patent [19]

du Plessis

[11] Patent Number: 4,669,392

[45] Date of Patent: Jun. 2, 1987

[54] BOTTOM DISCHARGE HOPPER RAIL CAR

[75] Inventor: Gysbert J. du Plessis, Potchefstroom, South Africa

[73] Assignee: Rotaque (Proprietary) Limited, Potchefstroom, South Africa

[21] Appl. No.: 681,876

[22] Filed: Dec. 14, 1984

[30] Foreign Application Priority Data

Dec. 22, 1983 [ZA] South Africa ..... 83/9567
Dec. 22, 1983 [ZA] South Africa ..... 83/9568

[51] Int. Cl.[4] ..... B61P 7/00

[52] U.S. Cl. ..... 105/247; 105/254; 105/250

[58] Field of Search ..... 105/247, 250, 239, 254, 105/404, 406 R, 407

[56] References Cited

U.S. PATENT DOCUMENTS 1,011,219 12/1911 McKee ..... 105/247
4,353,312 10/1982 Brower ..... 105/247 X
4,480,954 11/1984 Manström ..... 105/250 X

FOREIGN PATENT DOCUMENTS 417830 9/1924 Fed. Rep. of Germany ..... 105/250
973575 3/1960 Fed. Rep. of Germany ..... 105/254
4114 of 1912 United Kingdom .

*Primary Examiner*—Randolph A. Reese
*Assistant Examiner*—Glenn S. Foster
*Attorney, Agent, or Firm*—Fitch, Even, Tabin & Flannery

[57] ABSTRACT

Bottom discharge hopper rail cars generally have a chassis on flanged wheels, and a hopper body mounted on the chassis and including transversely and longitudinally extending edges which border a discharge opening from the body. In the present invention, the opening is wholly or substantially wholly at a level below the tops of the wheels but above the bottoms of the wheels and extends at least partly between pairs of said flanged wheels.

2 Claims, 2 Drawing Figures

BOTTOM DISCHARGE HOPPER RAIL CAR

Figure 1:
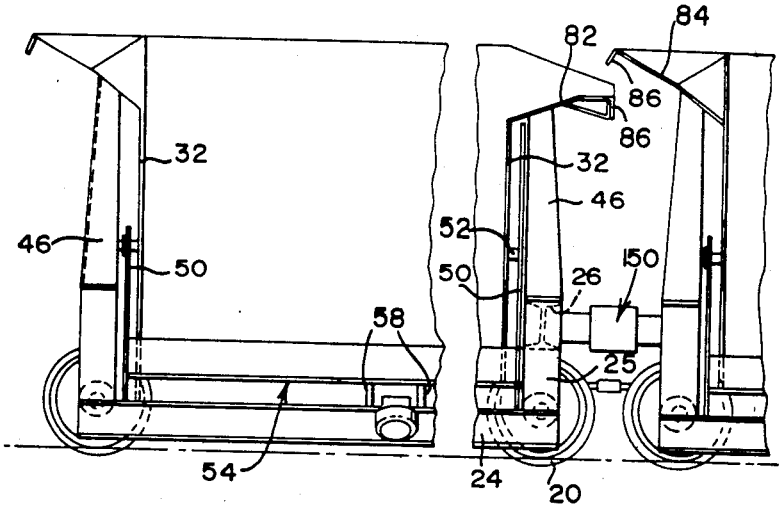

This invention relates to bottom discharge hoppers.

There has been extensive development in relation to bottom discharge hopper rail cars for the purposes of increasing the stability and the facility of discharge. Improving discharge capabilities is particularly important for mining or like conditions, where the materials to be discharged are "wet" and are inclined to bridge.

In U.S. Pat. No. 4,353,312, there is disclosed a bottom discharge hopper which has a relatively large discharge opening and asymmetrical side walls for the purpose of facilitating discharge of meterials. This is relatively successful in practice. However, the hopper body defines a cavity which holds the material at a relatively high level, which may lead to instability in certain cases.

Stability can be achieved by lowering the bottom of the cavity and hoppers having doors partly below the levels of the wheels (RSA Patent Specification 76/6091), wholly below the levels of the wheel tops (U.S. Pat. No. 4,062,460), and even doors below the wheels (U.S. Pat. No. 1,594,863). However, this has been achieved by reducing the door length, thereby reducing the discharge opening area.

It is desirable to improve on these earlier hoppers.

The present invention provides a bottom discharge hopper rail car comprising a hopper body mounted on a chassis which is itself supported on flanged wheels, the body including transversely and longitudinally extending edges which border a discharge opening from the body, the opening being wholly or substantially wholly at a level below the tops of the wheels but above the bottoms of the wheels and at least partly between pairs of said flanged wheels.

At least one door may be pivotally mounted on the body and displaceable between a closed condition in which said opening is closed by said at least one door, and an open condition to permit discharge of the contents of said body.

The longitudinally extending edges may be at the lower region of a pair of downwardly converging laterally spaced side walls, which may be asymmetrical with respect to a longitudinal vertical plane passing centrally between the wheels. In a preferred form of the invention, both of these longitudinal edges are below the tops of the wheels but are located one above another to allow a single door to be assymetrically mounted on the body.

The distance between the longitudinally extending edges may be greater than the spacing between wheels at opposite sides of the rail car, i.e. measured in a direction across the width of the car. Furthermore, the distance between the transversely extending edges may be slightly greater than the longitudinal spacing between the wheels at either side of the rail car. To ensure that this does not result in the door striking the wheels when the door moves to its open condition, the door is located and pivoted so that it swings through an arc passing above parts of the wheels during the course of its movement.

The chassis may be formed wholly or primarily by a chassis frame supporting the body and, to provide for the use of a relatively long opening in relation to the length of the chassis, the wheels may be located as close as is reasonably possible to the end of the chassis frame, for example project beyond the ends of the chassis frame.

Figure 2:
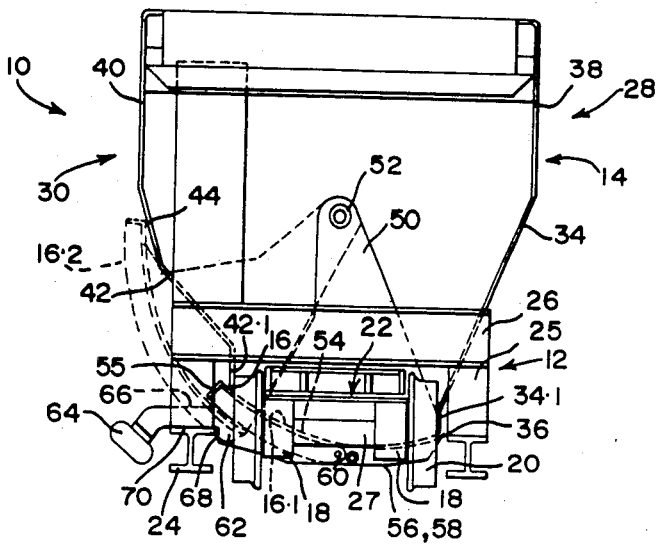

An embodiment of the present invention will now be described, by way of example, with reference to the accompanying drawings, in which FIG. 1 is a partial side elevation of two bottom discharge hopper rail cars in a train; and FIG. 2 is an end elevation of a hopper car of Figure 1.

Referring to FIGS. 1 and 2, a hopper car 10 is formed primarily from steel and comprises a chassis 12, a hopper body 14 defining a hopper cavity, and a door 16. The chassis is in the form of a chassis frame having longitudinally extending beams 24, transverse end beams 26, and suitably rigid spacer members 25 welded to and connecting these beams. The arrangement is such that the beams 24 are much lower than the beams 26.

Two wheel sets each including wheel bearings 18, are mounted in a suitable manner beneath the respective beams 26 and receive axles 27 which mount flanged wheels 20 having rail-engaging surfaces, laterally outwardly of their flanges. The wheels are located partly between the beams 24. A series of supports (not shown) extends upwardly from the chassis frame and supports the body.

The body comprises laterally spaced side walls 28 and 30 fixed on the chassis, and also two end walls 32. The side wall 28 includes a sloping wall 34 and a lower vertical wall in the form of strip 34.1 with a lower edge 36. A vertical wall 38 extends upwardly from the sloping wall 34. The side wall 30 has a vertical wall 40 which is parallel to and spaced laterally from the vertical wall 38, a further sloping wall 42 sloping upwardly from a lower vertical wall in the form of strip 42.1 with a lower edge 43, and an intermediate wall 44 which is between the walls 40 and 42, and is inclined at a relatively steep angle compared to the wall 42. The walls can be designed to reduce the height of or avoid the strips 34.1 and 42.1, if desired. The walls are strengthened by the stiffeners mentioned above, where necessary. The edges 36 and 43 and the lower edges of the end walls 32 border an opening at the bottom of the hopper cavity.

The width of the opening is greater than the spacing between the wheels in each wheel set, and the length of the opening is slightly less than the longitudinal distance between the wheels at each side of the rail car.

In order to keep the centre of gravity of the loaded hopper suitably low for any particular load, the bottom of the hopper cavity is located as low as is considered to be practical. As shown in FIG. 2, the bottom of the hopper cavity is at the position of the door opening and is below the level of the beams 26. It is also below the level of the tops of the wheels 20, but above the bottoms of the wheels and the rails. This arrangement is facilitated by locating the beams 24 well below the level of the beams 26 and largely at a level alongside the lower parts of the wheels 20, and by locating the wheel sets close to the ends of the hopper. As shown in FIG. 1, the wheels even project beyond the longitudinal ends of the chassis frame. The door is shaped and pivoted to swing above a respective beam 24 and to move through an arc passing between the respective wheels.

More specifically, the door 16 is capable of swinging between the positions illustrated at 16.1 and 16.2 in FIG. 2. To permit this movement to take place, while still providing some support for the hopper body on this side of the car, two vertically elongated end supports 46 of I-section are provided. The supports 46 extend upwardly from the chassis 12 and are secured to the walls 32, the supports being omitted from FIG. 2 in the interest of clarity.

The door 16 has two end plates 50 which are carried pendulum-fashion by trunnions 52 secured to supports 46 and end walls 32, the trunnions 52 mounting the end plates 50 between the supports 46 and the end walls 32 of the hopper body.

The door 16 further includes a curved base plate 54 (the concave face of the base plate being uppermost) which extends between and is secured to the end plates 50. The base plate 54 is strengthened by a pair of channels 56 which extends downwardly from the underside thereof. One of the longitudinal edges 55 of the base plate 54 is turned downwardly, which also enhances its strength.

Centrally of the door, the door is provided with two curved, parallel, transversely extending stiffeners 58. A pivot pin 60 is mounted on the stiffeners 58, and the pin 60 pivotally mounts an arm 62. The arm has a roller 64 rotatably mounted at its outer end.

The upper face of the arm 62 is shown at 66 and, in the closed position of the door, is spaced from the turned-down longitudinal edge 55 of the door. The lower side of the edge 55 constitutes an abutment surface, and the face 62 of the arm constitutes a complementary abutment face. Thus, when the roller 64 encounters a suitable tipping arm, the outer end of the arm 62 is lifted and there is some lost motion between the arm 62 and the door 16. The arm 62 pivots about the pin 60 with respect to the door 16 until the gap between the edge 55 and the arm has been taken up. Thereafter, further swinging movement of the arm 62 in an upward direction causes the door to move towards the position 16.2, the arm 62 remaining in engagement with the edge 55. As the door opens, discharge of material takes place between the beams 24.

The arm 64 has a stepped undersurface provided with a shoulder 68 for sitting adjacent to a complementary shoulder 70 on the beam 24 in the closed condition of the door. The relationship between the shoulder 68 and the shoulder 70 is such that, in the closed condition of the door, lateral movement of the arm and door towards the open position is prevented. However, during upward lost motion of the arm 62 with respect to the door edge 55, the shoulder 68 clears the shoulder 70 so that the shoulders are clear of one another by the time that the arm lifts the door in its upward swinging movement.

During subsequent closing movement of the door, the door and arm swing downwardly together until the door reaches its fully closed position. Thereafter, the arm moves downwardly and away from the door, and the shoulders are re-located.

To ensure that those portions of the door which are in sealing engagement with the lower edges of the walls 28 and 30 when the door is closed do not simply swing laterally with respect thereto, the axis of curvature of the base plate 54 of the door may be offset horizontally with respect to the axis of the trunnions 52. The movement of the base plate 54 may then include a slightly downward component with respect to the lower edges of the walls 28 and 30 to reduce the possibility of ore wedging the door solidly to the body.

Because of the curvature of the door and the manner in which the door is made, mounted and pivoted, the door clears the beam 24 and wheels 22 as it pivots.

As will be seen from FIG. 1, the upper ends of the end walls 32 of the hopper body are provided with diverging guide walls 82 and 84, which constitute overhanging portions of the body. The guide wall 82 terminates in a downwardly directed lip 86 while the wall 84 terminates in a downwardly directed lip 88. The walls 82 and 84 are such that, when two hopper cars are coupled end-to end in a train, the wall 84 and its lip 88 overhang the wall 82 and its lip 86. Thus, when the car is filled by moving under a continuous discharge of ore or the like, the overhanging walls 82 and 84 help to ensure that material will not be dumped between the cars onto the track.

When the hopper cars negotiate a bend in the track, the laterally outer ends of the wall 82 move one forwardly and one rearwardly with respect to the overhanging wall 84, and walls 82 and 84 are shaped and located to prevent engagement of one with the other.

I claim:

1. A bottom discharge hopper rail car comprising a chassis supported on forward and rear pairs of flanged wheels, the chassis having a forward end and a rearward end, a hopper body mounted on said chassis, said hopper body including a pair of downwardly converging, laterally spaced longitudinally extending side walls and a pair of substantially vertical, substantially parallel transverse end walls, said side walls being asymmetrical with respect to a longitudinal vertical plane passing centrally between the wheels, said side walls and end walls having lower regions providing longitudinally extending edges and transversely extending edges defining a discharge opening from the body, the opening being substantially at a level below the tops of the wheels but above the bottoms of the wheels and at least partly between the forward and rear pairs of flanged wheels, said bottom discharge hopper rail car further including a door pivotally mounted on said body for pivoting about a longitudinal axis thereof so as to be movable in an arcuate path between a closed condition in which said opening is closed by said door and an open condition to permit discharge of the contents of said hopper body through said discharge opening, said forward and rear pairs of wheels projecting longitudinally beyond the respective foward and rearward ends of the chassis, said chassis including a pair of beams extending longitudinally between said forward end and said rearward end, at least one of said beams being entirely disposed at a level below the axes of the wheels so as to be located beyond the path of said door.

2. A car according to claim 1, wherein the distance between the longitudinally extending edges is greater than the spacing between wheels at opposite sides of the rail car, measured in a direction across the width of the car.

* * * * *